United States Patent [19]

Künzel

[11] Patent Number: 4,651,655

[45] Date of Patent: Mar. 24, 1987

[54] METHOD FOR DISSOLVING SALT ENCRUSTATIONS IN A HEAT EXCHANGER

[75] Inventor: Jürgen Künzel, Thierhaupten, Fed. Rep. of Germany

[73] Assignee: Sigri GmbH, Meitingen bei Augsburg, Fed. Rep. of Germany

[21] Appl. No.: 836,162

[22] Filed: Mar. 4, 1986

[30] Foreign Application Priority Data

Mar. 6, 1985 [DE] Fed. Rep. of Germany ..... 3507882

[51] Int. Cl.[4] ..... B01D 53/34

[52] U.S. Cl. ..... 110/345; 55/90; 55/93; 55/222; 55/268; 110/215; 110/216; 165/95; 165/921

[58] Field of Search ..... 110/215, 216, 342, 344, 110/345; 165/921, 95, 905; 55/90, 93, 222, 268, DIG. 30

[56] References Cited

U.S. PATENT DOCUMENTS

| | | | |
|---|---|---|---|
| 3,231,015 | 1/1966 | Koch | 165/921 X |
| 3,755,990 | 9/1973 | Hardison | 55/93 |
| 4,477,373 | 10/1984 | Grantham et al. | 110/215 X |
| 4,557,202 | 12/1985 | Warner | 165/905 X |
| 4,574,062 | 3/1986 | Weitman | 55/222 X |

FOREIGN PATENT DOCUMENTS

| | | | |
|---|---|---|---|
| 2383396 | 11/1978 | France | 55/222 |

OTHER PUBLICATIONS

Publication, "Chemische Technologic", vol. 2, 4th edition, Mar. 3, 1982, p. 15.

*Primary Examiner*—Albert J. Makay
*Assistant Examiner*—Steven E. Warner
*Attorney, Agent, or Firm*—Herbert L. Lerner; Greenberg, Laurence A.

[57] ABSTRACT

Dissolving salt encrustations which are deposited by exceeding the saturation limit from a gas saturated with water vapor on the heat exchanging surfaces of a heat exchanger, by passing the gas through a heat exchanger subdivided into several sections. The predominant part of the sections is subjected to a hot fluid heating the gas saturated with water vapor and the smaller part of the sections to a cold fluid for cooling the gas below the dew point. The salt crust is dissolved in the cooled sections by the separated condensation water and the salt solution is drained from the heat exchanger. After the salt crust is removed, the cooled sections are subjected to the hot fluid and parts of the heated sections to the cold fluid.

11 Claims, 1 Drawing Figure

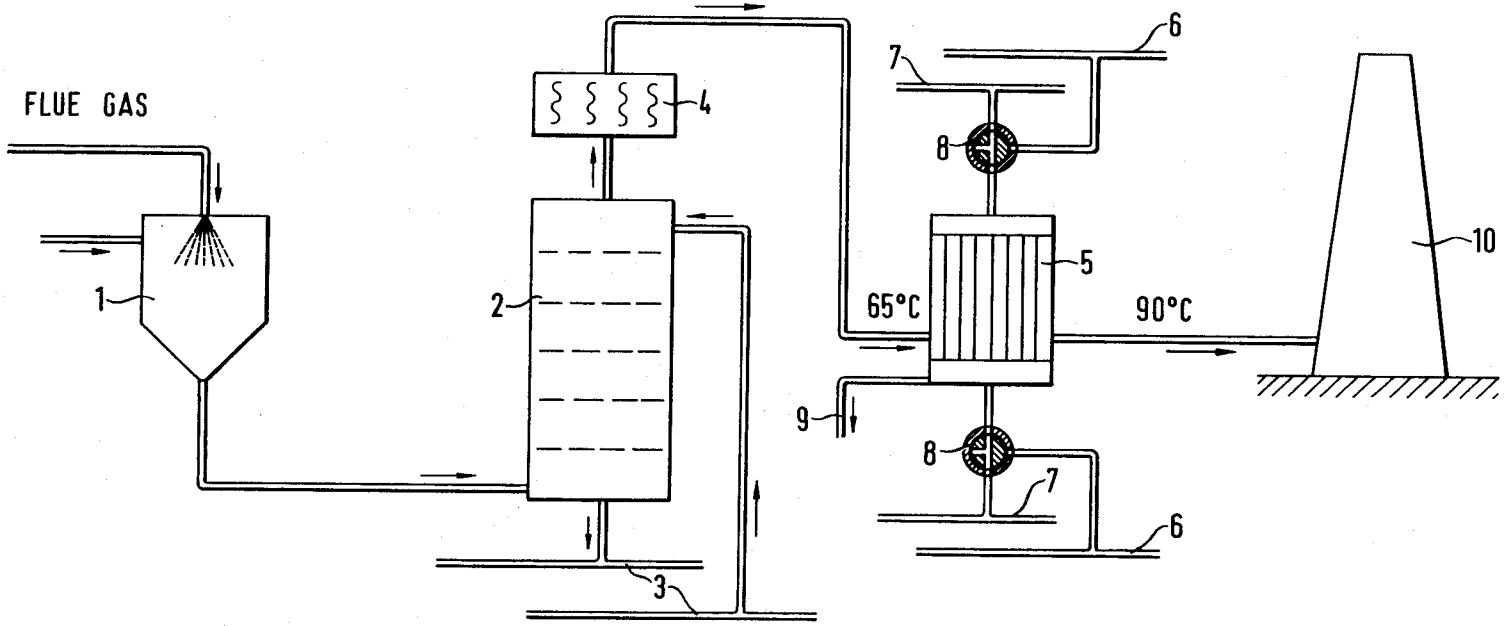
FLUE GAS
1
2
3
4
5
6
7
8
9
10
90°C
65°C

METHOD FOR DISSOLVING SALT ENCRUSTATIONS IN A HEAT EXCHANGER

BACKGROUND OF THE INVENTION

1. Field of the Invention

The invention relates to a method for dissolving salt encrustations which are deposited on the heat-exchanging surfaces of a heat exchanger from a gas saturated with water vapor by exceeding the saturation limit.

2. Description of the Prior Art

Methods are known in which gases saturated with water vapor are heated by a heat exchange to a temperature which is suitable for the physical or chemical treatments of the gas. Recuperative heat exchangers such as block, plate or particularly tube-bundle heat exchangers are frequently used for this purpose. If the water vapor/gas mixture contains mineral salts, the solubility of which drops with increasing temperature or if the amount of solvent is decreased in the heat exchanger, the deposition of the mineral substance on the hot surface of the heat exchanger cannot, as a rule, be avoided because the solution is heated or the solvent evaporates. The crusts which are more or less hard substantially reduce the performance of the heat exchanger and it is therefore customary to clean the heat-exchanging surfaces periodically, for instance, by boiling with acid or alkaline solutions. Plants, for instance, chemical plants which contain such heat exchangers can accordingly be operated continuously only if a substitute heat exchanger is connected for the period of cleaning.

It is also known, especially for removal of water-soluble salt encrustations, to spray water or possibly also aqueous solutions on the heat exchanger surfaces without interrupting the operation, the crusts being removed by the force of the impinging fluid and its dissolving power. Disadvantages of this method are the cooling-off of the gas if the temperature of the spraying water is lower than the normal exit temperature of the gas and, above all, the lowering of the dew point or the oversaturation of the gas with the dissolving medium. Corrosion of apparatus, piping and the like which follow the heat exchanger, can then usually be prevented only by making these parts of the plant of corrosion-proof materials, which is a technically costly solution.

SUMMARY OF THE INVENTION

It is therefore an object of the invention to remove salt encrustations from heat exchangers without the disadvantages described.

With the foregoing and other objects in view, there is provided in accordance with the invention a method for dissolving salt encrustations which are deposited on heat exchanging surfaces of a heat exchanger by exceeding the saturation limit from a gas saturated with water vapor, which comprises passing a gas saturated with water vapor through a heat exchanger which is subdivided into a plurality of sections, subjecting a major portion of the sections to a hot fluid to heat the gas saturated with water vapor passing through said heated sections, subjecting a minor portion of the sections to a cold fluid to cool the gas saturated with water vapor passing through said cooled sections below the dew point to condense the water vapor; effecting dissolution of salt crust in the cooled sections by contact with the condensation water, draining the resultant salt solution from the heat exchanger, thereafter subjecting the cooled sections to the hot fluid, and subjecting another minor portion of the heated sections encrusted with salt to the cold fluid to effect dissolution of salt crust therein.

Other features which are considered as characteristic for the invention are set forth in the appended claims.

Although the invention is illustrated and described herein as embodied in a method for dissolving salt encrustations in a heat exchanger, it is nevertheless not intended to be limited to the details shown, since various modifications may be made therein without departing from the spirit of the invention and within the scope and range of equivalents of the claims.

BRIEF DESCRIPTION OF THE DRAWING

The invention however, together with additional objects and advantages thereof will be best understood from the following description when read in connection with the accompanying drawing which diagrammatically illustrates apparatus for carrying out the invention in which flue gas is scrubbed with a solution, first in a pre-scrubber and then in a main scrubber. The scrubbed flue gas passes through a droplet separator which is capable of removing a considerable amount but not all entrained droplets of liquid containing dissolved salts which are carried into the heat exchanger shown as a section. The drawing shows the section of heat exchanger equipped with valve means to feed a hot fluid to heat the flue gas or to feed a cold fluid to cool the flue gas below the dew point to effect condensation of the water vapor. This condensate dissolves the salt encrustation and the resultant salt solution is drained from the heat exchanger. The flue gas leaving the heat exchanger and combined from all the sections is above the dew point and goes to the flue.

DESCRIPTION OF THE PREFERRED EMBODIMENTS problem relating to removal of salt encrustations in a heat exchanger is solved by a heat exchanger which is subdivided into several sections and the predominant number of sections are subjected to a hot fluid for heating the gas saturated with water vapor and a lesser number of sections subjected to a cold fluid for cooling the gas below the dew point; the salt encrustations are dissolved in the cooled sections by the separated condensate water; the salt solutions are drained from the heat exchanger and the cooled sections are acted upon by the hot fluid after the salt crusts are removed by the cold fluid, and another part of the heated sections are acted upon by the cold fluid.

The invention is based on the insight to use the water contained in the gas stream as the solvent for the interfering salt encrustations. To this end, part of the gas stream to be heated is cooled below the dew point, in the process of which water droplets are separated at the heat-removing surfaces in direct contact with the salt encrustations, and a concentrated salt solution is formed which runs off from the heat exchanging surfaces in a short time. With a constant gas flow, the available amount of water is proportional to the moisture content of the fed-in gas, the temperature drop and the cooling time. By changing these parameters, the method can be adapted to the respective operating requirements within wide limits. After the salt crusts are dissolved, another part of the heat exchanger is cooled and the cooled part is again subjected to a hot fluid.

By subdividing the heat exchanger into several sections and heating the larger part and cooling the smaller part of the sections, several substreams analogous to the number of sections with two different temperatures are obtained. Advantageously, the substreams are mixed with each other to produce a homogeneous gas stream, for instance, by turbulent flow, the temperature of which can be calculated in a manner known per se in good approximation from the mass ratio of the substreams and the ratio of the temperature. Each section of the heat exchanger is equipped with a separate feed and discharge line for the hot and the cold fluid and with the usual means for switching from the one to the other fluid. The hot fluid to be used, may, for instance be hot water, steam or a thermal oil and the cold fluid may be cold water or a brine.

The number of sections of a heat exchanger which must be cooled in each case for the complete removal of the salt encrustations depends in detail on the solubility of the salt and the separated amount of water, ordinarily, cooling 5 to 20% of the sections will be sufficient for effective removal of salt encrustations. The method can be applied to all gases saturated with water vapor, the temperature of which is to be increased in a heat exchanger. Flue gases which contain water-soluble salts, for instance, after a desulfurization can be treated especially advantageously. The salt solutions formed in the cooled section accordingly have a more or less corrosive action and it is advisable to use heat exchangers of corrosion-resisting materials. Particularly advantageous are heat exchangers of graphite which are resistant to numerous solutions.

The invention will be described in greater detail in the following, making reference to an example and the drawing as embodiments of the invention. A customary method for the desulfurization of flue gases is the process patterned after Wellmann-Lord (Winnacker-Kuechler, Chemische Technologie, volume 2, 4th Edition, Munich, 1982, 15). In this method, $SO_2$ is scrubbed from the flue gas in an absorber with a solution rich in sodium sulfite.

Referring to the drawing, the flue gas flows through the pre-scrubber 1 and the main scrubber 2, which is followed by the droplet separator 4. The scrubbing solution rich in sodium sulfite flows via pipes 3 through the main scrubber 2 downwardly in counter-flow to the uprising flue gas. The scrubbing solution loaded with $SO_2$ is drained off and is returned into the circuit after the $SO_2$ is driven out (not shown in the drawing). A heat exchanger is arranged, of which a section designated 5 is shown graphically after the droplet separator 4, as seen in the flow direction of the flue gas. The purpose of the heat exchanger is to heat the desulfurized gas from about 65° to 90° C. Since salt-containing drops of liquid are retained only in part in the separator 4, the gas leaving separator 4 carry with it droplets to the hot surfaces of the heat exchanger. These droplets are salt solutions and because of the higher temperature of the heat exchanger at least part of the solvent evaporates resulting in oversaturation of salt in the droplets. Consequently, salt precipitates and the heat-exchanging surface is encrusted. To effect removal of the salt encrustations, the feeding and discharge of hot fluid through the pipelines 6 is interrupted by changing the position of the valves 8, and a cold fluid is fed to the heat exchanger via the lines 7. Heat is now removed from the purified flue gas stream and its temperature is lowered below the dew point thereby resulting in condensation of moisture in the flue gas. The condensate produced settles on the salt encrustation and by dissolving at least part of the salt encrustation separates it from the heat exchanging surfaces. The condensate-salt solution flows off and is drained off via the line 9. Section 5 of the heat exchanger is then again subjected to the hot fluid and another section, not shown in the drawing, is subjected to the cold fluid. Overall, the heat exchanger made of graphite contained 10 sections; 9 sections were heated and 1 section was cooled.

The substreams leaving the sections are combined in a gas stream with a temperature of about 85° to 90° C. The gas stream does not contain salts entrained from the scrubbing solution, especially sodium sulfite and sodium sulfate. The gas temperature, which is far above the dew point, is sufficient to generate an up-draft in the flue 10. Corrosion of the flue 10 and of the units and pipelines which are arranged between the heat exchanger 5 and the flue 10, are for all practical purposes precluded.

The foregoing is a description corresponding, in substance, to German application No. P 35 07 882.0, dated Mar. 6, 1985, international priority of which is being claimed for the instant application and which is hereby made part of this application.

Any material discrepancies between the foregoing specification and the specification of the aforementioned corresponding German application are to be resolved in favor of the latter.

There is claimed:

1. Method for dissolving salt encrustations which are deposited on heat exchanging surfaces of a heat exchanger by exceeding the saturation limit from a gas saturated with water vapor, which comprises passing a gas saturated with water vapor through a heat exchanger which is subdivided into a plurality of sections, subjecting a major portion of the sections to a hot fluid to heat the gas saturated with water vapor passing through said heated sections, subjecting a minor portion of the sections to a cold fluid to cool the gas saturated with water vapor passing through said sections below the dew point to condense the water vapor, effecting dissolution of salt crust in the cooled sections by contact with the condensation water, draining the resultant salt solution from the heat exchanger, thereafter subjecting the cooled sections to the hot fluid, and subjecting another minor portion of the heated sections encrusted with salt to the cold fluid to effect dissolution of salt crust therein.

2. Method according to claim 1, wherein the heat exchanger is fabricated from graphite.

3. Method according to claim 1, wherein the heat exchanger is a tube-bundle heat exchanger.

4. Method according to claim 3, wherein the heat exchanger is fabricated from graphite.

5. Method according to claim 1, wherein said gas saturated with water vapor passing through the heat exchanger is a flue gas saturated with water vapor.

6. Method according to claim 5, wherein the heat exchanger is a a tube-bundle heat exchanger.

7. Method according to claim 5, wherein the heat exchanger is fabricated from graphite.

8. Method according to claim 1, wherein 5 to 20% of the sections are cooled.

9. Method according to claim 8, wherein said gas saturated with water vapor passing through the heat exchanger is a flue gas saturated with water vapor.

10. Method according to claim 8, wherein the heat exchanger is a tube-bundle heat exchanger.

11. Method according to claim 8, wherein the heat exchanger is fabricated from graphite.

* * * * *